United States Patent [19]

Johnson et al.

[11] Patent Number: 4,582,222

[45] Date of Patent: Apr. 15, 1986

[54] BINGO CARD DISPENSER

[76] Inventors: Robert E. Johnson, 110 Fourth St., Dearborn Heights, Mich. 48127; Jim S. Maddux, 8058 Mortenview, Taylor, Mich. 48180

[21] Appl. No.: 612,458

[22] Filed: May 21, 1984

Related U.S. Application Data

[63] Continuation-in-part of Ser. No. 431,848, Sep. 30, 1982, abandoned.

[51] Int. Cl.[4] ..... B65G 59/06; B65H 3/44

[52] U.S. Cl. ..... 221/129; 221/241; 312/60

[58] Field of Search ..... 221/129, 131, 241, 296, 221/304; 312/50, 60; 133/4 R, 4 A

[56] References Cited

U.S. PATENT DOCUMENTS

| | | | |
|---|---|---|---|
| 426,194 | 4/1890 | Morlan | 312/60 |
| 450,271 | 4/1891 | White | 312/60 |
| 2,435,371 | 2/1948 | Stout | 133/2 X |
| 3,061,143 | 10/1962 | Simjian | 221/129 X |
| 3,437,238 | 4/1969 | Luba | 221/129 |
| 3,439,834 | 4/1969 | Carter | 221/7 |
| 3,757,997 | 9/1973 | Millies et al. | 221/241 |
| 3,841,341 | 10/1974 | Englund et al. | 133/4 R |

FOREIGN PATENT DOCUMENTS

| | | | |
|---|---|---|---|
| 338354 | 11/1930 | United Kingdom | 221/241 |

*Primary Examiner*—F. J. Bartuska

*Attorney, Agent, or Firm*—Charles W. Chandler

[57] ABSTRACT

A multi-chute bingo card dispenser having a solenoid-actuated pusher member disposed adjacent the bottom of each chute for stripping off a predetermined number of bingo cards from a stack of cards in the chute. A block and shims are mounted at the bottom of each chute to define the height between the bottom of the block on which the cards are supported and a stripper plate mounted above the chute bottom to precisely define the number of cards being stripped from the bottom of a stack when the pusher is actuated.

4 Claims, 4 Drawing Figures

BINGO CARD DISPENSER

CROSS-REFERENCE TO RELATED APPLICATIONS

This application is a continuation-in-part of application Ser. No. 431,848 filed Sept. 30, 1982 for "Bingo Card Dispenser", now abandoned.

BACKGROUND OF THE INVENTION

This invention is related to automatic bingo card dispensing apparatus, and more particularly to such apparatus in which a group of a predetermined number of cards are stripped from a stack of cards by a pusher member with means for adjusting the number of cards in the group.

Bingo cards are usually dispensed manually at a bingo hall in groups such as 5, 10 or 15, depending on the number the player desires to use. Some automatic bingo card dispensers are disclosed in the prior art, however, they have not been generally commercially accepted. For example, U.S. Pat. No. 3,445,035 was issued to H. J. Ackerman on May 20, 1969. The Ackerman patent discloses a device for automatically dispensing a selected number of cards, however, he employs a series of stacks with one card being stripped from the bottom of each stack. The number of stacks being stripped depends upon the number of push buttons being energized.

One of the problems associated with bingo card dispensers is that the thickness of the cards varies over a period of time, that is, they tend to expand with use. The Ackerman device does not have adjustable means for accommodating the variable thickness of a group of bingo cards.

SUMMARY OF THE INVENTION

The broad purpose of the present invention is to provide an automatic bingo card dispenser for stripping a selected number of bingo cards from a stack of such cards with means for adjusting the discharge opening through which the cards are being stripped. In the preferred embodiment of the invention, which will be described in greater detail, a block is mounted at the bottom of the chute. The cards are stacked on the block. A stripper plate is mounted adjacent the chute to provide means for stripping the bottom of the stack when a pusher member engages the cards. Shim means are disposed beneath the block to precisely define the distance between the stripper plate and the block thereby providing means for precisely determining the number of cards being stripped.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
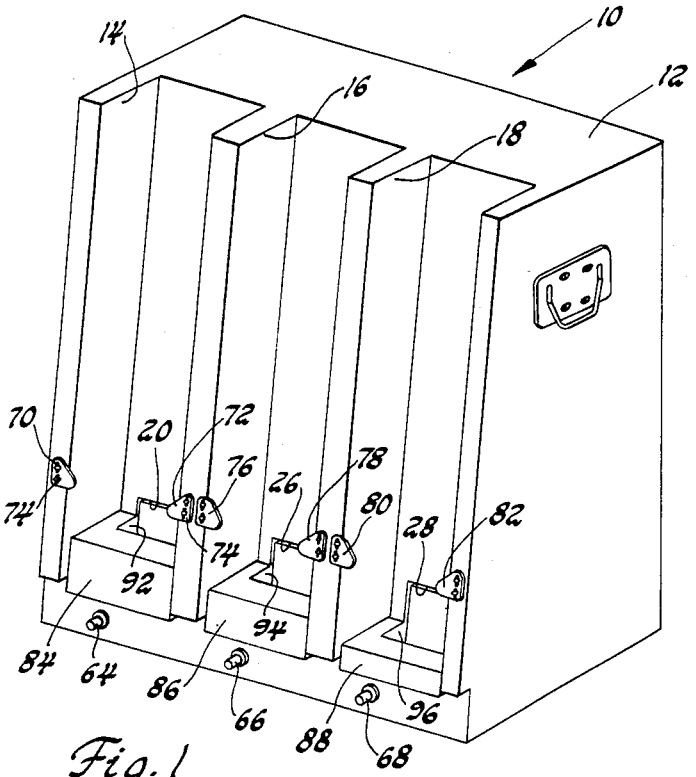
FIG. 1 is a perspective view of an automatic bingo card dispenser illustrating the preferred embodiment of the invention.
Figure 2:
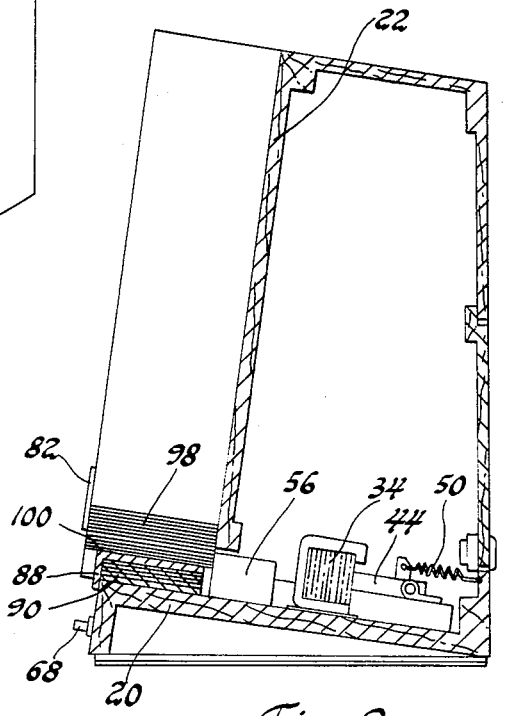
FIG. 2 is an elevational sectional view of the dispenser of FIG. 1.

Referring to the drawing, a preferred bingo card dispensing apparatus 10 is illustrated in FIG. 1 and comprises housing 12 having three upright three-sided chutes 14, 16 and 18, each adapted to receive a stack of conventional bingo cards. As best illustrated in FIG. 2, each chute is disposed at a slight vertical angle.

The housing has a base 20 at the bottom of each chute, and a back wall 22 defining the rear wall of each chute. Wall 22 has openings 24, 26 and 28 opening adjacent the bottom of chutes 14, 16 and 18, respectively.

Three electrically actuated solenoids 30, 32, and 34 are mounted on base 20 rearwardly of openings 24, 26 and 28, respectively.

Three identically shaped pusher means 36, 38 and 40 are slideably mounted on the base rearward of openings 24, 26 and 28 respectively. Each of the pusher members has a central opening 42 encircling its respective solenoid. Each solenoid has a push rod 44 connected to its pusher member.

Figure 3:
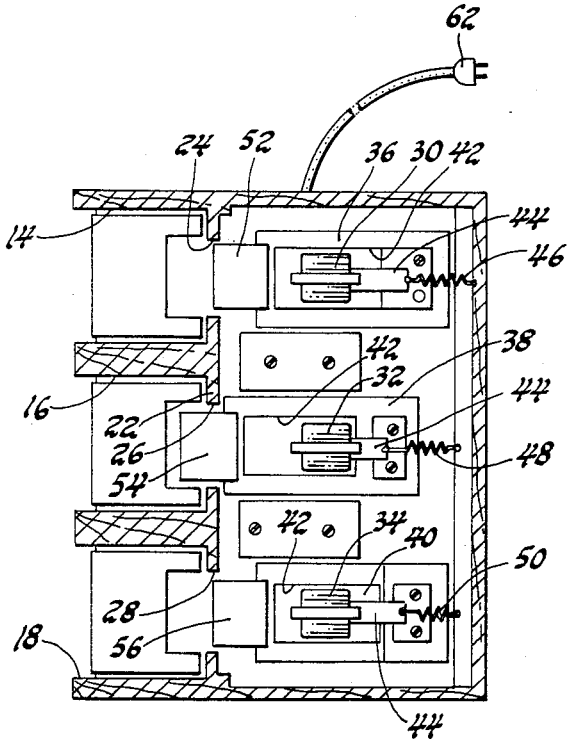
FIG. 3 is a plan sectional view showing the pusher means disposed in the bottom of the dispenser.

Spring 46 connects the push rod of solenoid 30 to the housing to move the rod rearwardly or toward the right as viewed in FIG. 3. Similarly, spring member 48 connects the push rod of solenoid 32 to the housing while a third spring 50 connects the push rod of solenoid 34 to the housing so that each push rod is biased toward the rear of the housing, away from its respective chute. When each solenoid is electrically energized it retracts its push rod so as to move its respective pusher member toward its corresponding chute. Pusher means 36 has a block 52 receivable through opening 24 for engaging the bingo cards in chute 14 while pusher means 38 has a block 54 receivable through opening 26, and pusher means 40 has a block 56 receivable through opening 28 for stripping the cards from the bottom of the stack located in chutes 16 and 18, respectively. As viewed in FIG. 3, blocks 52 and 56 are illustrated in their retracted position while block 54 is illustrated in a position to strip the bottom cards from a stack (not shown) in chute 16.

Figure 4:
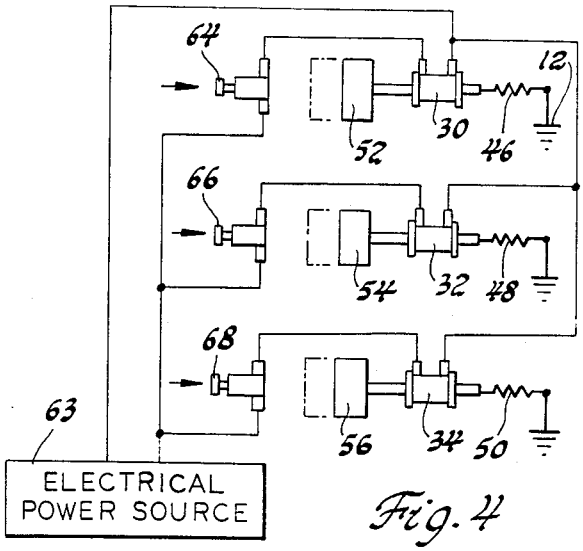
FIG. 4 is an electrical schematic of the preferred apparatus.

FIG. 4 illustrates an electrical schematic of circuit 60 for the solenoids which are connected by plug 62 to a power source 63. The circuit includes three push button switches 64, 66 and 68 for energizing solenoids 30, 32 and 34 respectively.

A pair of slotted stripper plates 70 and 72 are connected by fastener means 74 on opposite sides of chute 14. The stripper plates have vertical fastener receiving slots so that the vertical position of each stripper plate can be adjusted within a range of about a ½ inch. Similarly a second pair of slotted stripper plates 76 and 78 are mounted on opposite sides of chute 16, and a third set of slotted stripper plates 80 and 82 are mounted on opposite sides of chute 18. The three pairs of stripper plates are preferably mounted at about the same vertical height above base 20. Each pair is designed to define the upper portion of a discharge opening for the bingo cards.

Block 84 is mounted at the bottom of chute 14 while a similar block 86 is mounted at the bottom of chute 16 and a third block 88 is mounted at the bottom of chute 18. It is to be noted that each block has a different thickness. The cards in the chutes are stacked on the top surface of blocks 84, 86 and 88. Referring to FIG. 2, each block has a generally L-shaped cross-section and shim means 90 are disposed between base 20 and the bottom of the block so as to precisely position the top surface of the block with respect to the bottom edge of the stripper plates in the corresponding chute.

The blocks have recesses 92, 94 and 96 which receive the pusher blocks in a stripping motion in which the bottom cards beneath the stripper plates are pushed from the bottom of the stack.

It is to be noted that the height of the discharge opening of chute 18 is greater than that of chute 16 and chute 14 so that, for example, a group of 15 cards may be stripped from chute 18, ten cards may be stripped from the bottom of the stack in chute 16 and five cards stripped from the bottom of the stack in chute 14.

As viewed in FIG. 2, the cards stripped from the bottom of a stack of cards 98 would be those disposed between the top of block 88 and the bottom of stripper plate 82. Shim means 90 as well as the slots in the stripper plates permit the height of the discharge opening to be very finely adjusted to accomodate the thickness of the bingo cards disposed in each chute. Thus this arrangement permits the user to dispense a predetermined number of cards from a chute depending upon whether push button 64, 66 or 68 is being pushed.

In operation, the cards are stacked in chutes 14, 16 and 18. When the user pushes the selected push button switch 64, 66 or 68, the corresponding solenoid causes the corresponding number of cards to be dispensed.

Having described our invention, we claim:

1. A bingo card dispenser, comprising:

a base, chute means mounted on the base for receiving a stack of bingo cards, the chute means having a first opening and a second opening adjacent the base;

a pusher member slideably mounted on the base for movement through the first opening toward the second opening, the pusher member having a top surface disposed at a first height above the base;

a block mounted on the base and having a top surface for slideably supporting the bottom-most card of a stack of cards, the top surface of the block being disposed a second height, less than said first height;

adjustable shim means disposed on the base beneath the block to support the top surface of the block above the base to adjust the difference in the distance between the top surface of the block and the top surface of the pusher member according to the collective thickness of a predetermined number of bingo cards;

stripper plate means mounted adjacent the second opening to adjust the height of the stripper plate means above the top surface of the pusher member so as to permit only said predetermined number of cards to pass through the second opening from the bottom of the stack of cards as the pusher member is moving through the first opening in pushing relationship with the cards;

solenoid means mounted on the base and connected to the pusher member for moving same through the first opening;

spring bias means connected to the pusher member for moving same in the opposite direction; and means for actuating the solenoid means to strip said predetermined number of cards from the bottom of a stack of cards disposed in the chute means.

2. A bingo card dispenser as defined in claim 1, in which the block has a generally "U" shaped configuration defining an opening for receiving the pusher member as the pusher member engages the cards to push them through the second opening.

3. A combination as defined in claim 1, in which the housing has a second vertical chute disposed adjacent to and parallel to the first mentioned chute, and including a second pusher member and means for moving the second pusher member toward the bottom of the second chute for stripping a predetermined number of cards from the bottom of a stack disposed in the second chute, and a block mounted in the bottom of the second chute so as to define a bottom discharge opening for dispensing a second predetermined number of cards from the second chute.

4. A combination as defined in claim 1, in which the solenoid means is mounted on said base, and said pusher member comprises a member slideably mounted on the base and having an opening, the solenoid means being disposed in the opening, and means connecting the solenoid means to the pusher member for moving it toward the discharge opening.

* * * * *